US007387558B2

(12) United States Patent
Swisher et al.

(10) Patent No.: US 7,387,558 B2
(45) Date of Patent: Jun. 17, 2008

(54) INTERACTIVE TOY VEHICLE

(75) Inventors: Gary Swisher, Rolling Hills Estates, CA (US); Keith Hippely, Manhattan Beach, CA (US); Bill O'Keefe, Redondo Beach, CA (US)

(73) Assignee: Mattel, Inc., El Segundo, CA (US)

( * ) Notice: Subject to any disclaimer, the term of this patent is extended or adjusted under 35 U.S.C. 154(b) by 23 days.

(21) Appl. No.: 11/418,684

(22) Filed: May 4, 2006

(65) Prior Publication Data

US 2007/0259599 A1 Nov. 8, 2007

(51) Int. Cl.
*A63H 17/14* (2006.01)
*A63H 17/00* (2006.01)

(52) U.S. Cl. ..... 446/427; 446/77; 446/470

(58) Field of Classification Search ..... 446/424, 446/425, 427, 308, 470, 71–78
See application file for complete search history.

(56) References Cited

U.S. PATENT DOCUMENTS

| | | | | |
|---|---|---|---|---|
| 757,834 | A | | 4/1904 | Patten et al. |
| 3,191,343 | A | | 6/1965 | Goldfarb |
| 3,624,957 | A | * | 12/1971 | Good ..... 446/425 |
| 4,307,533 | A | | 12/1981 | Sims et al. |
| 4,324,065 | A | | 4/1982 | Cooper |
| 4,424,978 | A | | 1/1984 | Kassai |
| 4,568,307 | A | | 2/1986 | Gabler et al. |
| 4,689,033 | A | | 8/1987 | Droller et al. |
| 4,712,968 | A | * | 12/1987 | Manning ..... 414/694 |
| 4,717,367 | A | | 1/1988 | Stubenfoll et al. |
| 4,772,242 | A | | 9/1988 | McKay et al. |
| 4,778,433 | A | | 10/1988 | McKay et al. |
| 4,911,669 | A | | 3/1990 | Parker |
| 4,917,648 | A | * | 4/1990 | Hartje ..... 446/424 |
| 5,052,680 | A | | 10/1991 | Malewicki et al. |
| 5,267,888 | A | | 12/1993 | Hippely et al. |
| 5,292,275 | A | | 3/1994 | Swisher et al. |
| 5,310,379 | A | | 5/1994 | Hippely et al. |
| 5,334,078 | A | | 8/1994 | Hippely et al. |
| 5,626,506 | A | | 5/1997 | Halford et al. |
| 6,011,489 | A | * | 1/2000 | Ki Kwan et al. ..... 340/825.72 |
| 6,017,262 | A | | 1/2000 | Starnes |
| 6,699,096 | B2 | | 3/2004 | Christopherson et al. |
| 2001/0041497 | A1 | | 11/2001 | Hornsby et al. |
| 2006/0003666 | A1 | | 1/2006 | Hardouin et al. |
| 2006/0014470 | A1 | | 1/2006 | Takahashi et al. |

* cited by examiner

*Primary Examiner*—Kien T Nguyen
(74) *Attorney, Agent, or Firm*—Edell, Shapiro & Finnan LLC

(57) ABSTRACT

A toy vehicle having an interactive feature, the toy vehicle comprising a body at least two wheels rotatably coupled to the body; and a tongue actuation mechanism moveably coupled to the body, the tongue actuation mechanism including a tongue extender having an engagement portion, the tongue actuation mechanism is adapted to enable selective movement of the tongue extender from a storage position to a capture position, where in the capture position the tongue extender extends downwards approaching a ground surface for capture of an object to the engagement portion of the tongue extender.

29 Claims, 7 Drawing Sheets

INTERACTIVE TOY VEHICLE

BACKGROUND AND SUMMARY

Toy vehicles have been popular play items for many years. Scaled or miniature toy vehicles are engaging toys for children and may find value as collector items. By providing multiple play configurations, play value with the vehicles may be increased. For example, a toy may include a first play configuration where the toy simulates a real-life vehicle and a second play configuration where the toy simulates a fantastical or imaginary creature or animal.

The inventors herein have recognized that the play value of such toy vehicles may be enhanced by providing interactive features on the vehicles. Further, simulation of both real and fantastical elements may further enhance play value. Interactive play elements may be included further enhancing the simulation aspect of the toy vehicle. For example, in one approach, a toy vehicle having a plurality of play configurations and interactive features may be provided.

For example, a toy vehicle having an interactive feature may include a body, at least two wheels rotatably coupled to the body, and a tongue actuation mechanism moveably coupled to the body. The tongue actuation mechanism may include a tongue extender having an engagement portion. In some embodiments, the tongue actuation mechanism may be adapted to enable selective movement of the tongue extender from a storage position to a capture position. In the capture position, the tongue extender may extend downwards approaching a ground surface for capture of an object to the extender portion of the tongue extender. The tongue actuation mechanism may be triggered through a user-manipulable actuator. The actuator may simulate a tail.

As another approach, a toy may provide enhanced simulation by inclusion of interactive features. For example, a toy may include a body having a user-manipulable actuator. The body may also include a mouth moveable upon activation of the actuator, where the mouth may be moveable between at least one open configuration and a closed configuration. Additionally, the toy may also have a tongue moveable from a storage position to an extended position upon movement of the mouth to the open configuration. In the storage position, the tongue may be substantially disposed in the mouth. In the extended position, the tongue may be disposed upward and outward and may include a four bar linkage.

As another example, a toy vehicle may have a body including a mouth having at least one moveable portion and a tongue. The tongue may be moveable between a storage position providing a first play configuration and a capture position providing a second play configuration. When the tongue is in the capture position, the tongue may be adapted to extend downwards towards a ground surface to capture an object. The toy vehicle may include a third play configuration where the tongue remains in a storage position and the mouth is in a partially open position. Further, the tongue may include engagement structure, including, but not limited to a sticky contact surface to enable capture of an object. In some embodiments, the object may be lifted to the mouth. In this way a fourth play configuration may be provided.

The various play configurations may add excitement to the toy or toy vehicle. Moreover, the various play configurations may enable confrontational play and simulated play. For example, interactive mechanisms may enhance the appearance of the toy such that it more closely resembles a beast or animal.

DETAILED DESCRIPTION

Figure 1A:
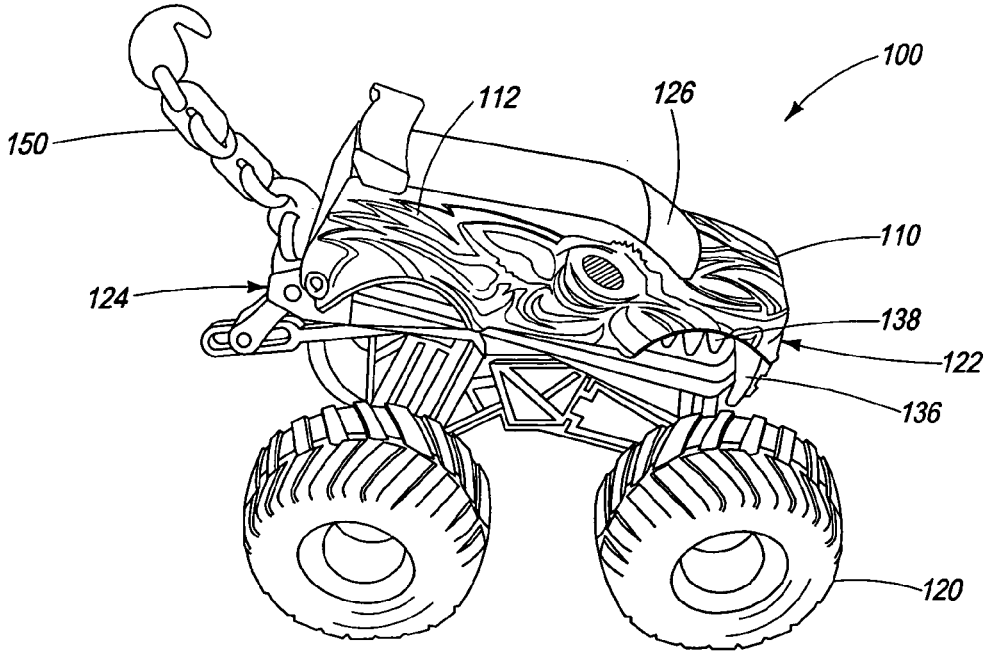
FIG. 1A is a side view of an example interactive toy vehicle in a first configuration.

FIGS. 1A-1D illustrate an example interactive toy vehicle in a plurality of play configurations. In one example, FIG. 1A provides an exemplary toy 100. Toy 100 may be configured to simulate a vehicle, such as a racing vehicle, a truck, a car, an amphibious vehicle, an airplane, a boat, etc. In some embodiments, toy 100 may be configured to assume an animal-like appearance, such as a real or fantastical animal or beast. For example, toy 100 may appear as a dragon, a snake, a crocodile, a lizard, a dinosaur, etc.

Toy vehicle 100 may include a body or chassis 110 and one or more wheels 120 rotatably coupled to the body 110. For example, in the illustrated embodiment, toy vehicle 100 may include four wheels, two front wheels and two rear wheels, although other wheel configurations may be possible. Thus, it should be appreciated that toy vehicle 100 may have any number of wheels, including, but not limited to one wheel, two wheels, three wheels, five wheels, etc. Further, such wheels may be disposed on any section of the vehicle, e.g. front wheels, side wheels, rear wheels, mid-chassis wheels, etc. In FIGS. 1A-1D, the wheels may be over-sized such that the vehicle simulates an oversized truck, such as a monster truck. However, other configurations are possible. For example, in some embodiments the wheels of the vehicle may be of different sizes. The number of wheels, the configuration of the wheels, and/or the size of the wheels may add play value to the vehicle. It further should be noted that, in some embodiments, wheels 120, may take other forms, including but not limited to legs, feet, balls, tracks, skis, paddles, etc.

Body or chassis 110 may be configured to represent a fanciful figure. For example, in some embodiments, body 110 may include structure to give the body the appearance of a creature or beast. For example, the body 110 may include a mouth, a tail, teeth, a tongue, eyes, limbs, legs or appendages, scales, ears, stomach, neck, etc. Thus, in some embodiments, the body may provide the appearance of a monster, dragon, alien or other fanciful beast.

Although described and illustrated in regards to a vehicle representing a fanciful creature, it should be appreciated that the vehicle may simulate other creatures, including real creatures, such as lizards, bears, dolphins, whales, snakes, frogs and other animals, as well as fanciful creatures or combinations of real creatures. Further in some embodiments, the body may provide the appearance of various objects, including, but not limited to, carriages, space ships, racecars, etc.

Design elements may be provided on the body to enhance the play value of the toy. Such design elements may include enhancements 112, such as inclusion of markings which add to the simulation of the toy. For example, enhancements may make the toy vehicle more animal-like. Such enhancements may include painting, stickers, decals, moldings, accessories, etc. As an illustration, in FIG. 1A, the vehicle may include striping, color variations, and the like to simulate the exterior of an animal. Further, enhancements such as eyes 114, nostrils, teeth, gills, claws, etc. may further be provided to increase the level of simulation of the toy.

Some of these enhancements may include moveable or interactive features. For example, in some embodiments, eye 114 may include a moveable portion such that the eye is enhanced or visible in some play configurations and not in others. For example, the eye may shut or be more or less pronounced (or colored) in some play configurations. As an example, the window may be linked with the upper jaw such that when the mouth is opened, the moveable eye portion occupies a viewable window region, exposing an alternative eye configuration. When the mouth is closed, the moveable portion may move outside of the viewable portion of the window and may be hidden within the body of the vehicle. Other enhancements may similarly be linked with the opening and closing of the mouth.

The body of the vehicle may be a single piece body, although in some configurations the body may be composed of multiple pieces. The body pieces may be movably or hindgedly coupled together. Further, the wheels may be linked to the body through front and rear axles. Steering may be accomplished by tilting the body.

For ease of description, toy vehicle 100 may include a front portion 122 and a rear portion 124. Windows may be provided on the body, including a front windshield 126, side windows, and/or rear windows.

Figure 1B:
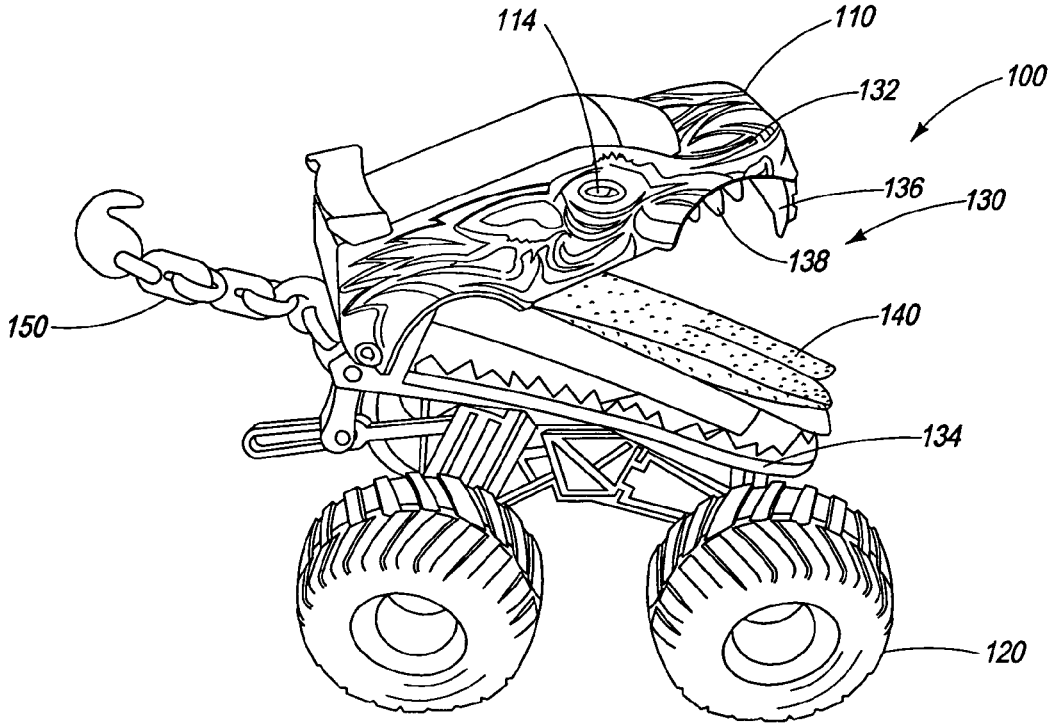
FIG. 1B is a side view of the toy vehicle of FIG. 1A in a second configuration.

Additional features may provide enhanced simulation. In the illustrated embodiment, the body may include a mouth 130. Referring to FIG. 1B, mouth 130 may include an upper jaw 132 and a lower jaw 134. The mouth may be configured to open and close such that the body may be considered to be in multiple play configurations. For example, FIG. 1A illustrates a first play configuration with a closed mouth, while FIG. 1B illustrates a second play configuration where the mouth is in a first partially open position. In the closed mouth configuration, some enhancements may be visible, such as but not limited to fangs 136, teeth 138, lips, etc. In the configuration shown in FIG. 1B, additional enhancements may be visible, including a tongue 140, additional teeth, fangs, etc.

Figure 1C:
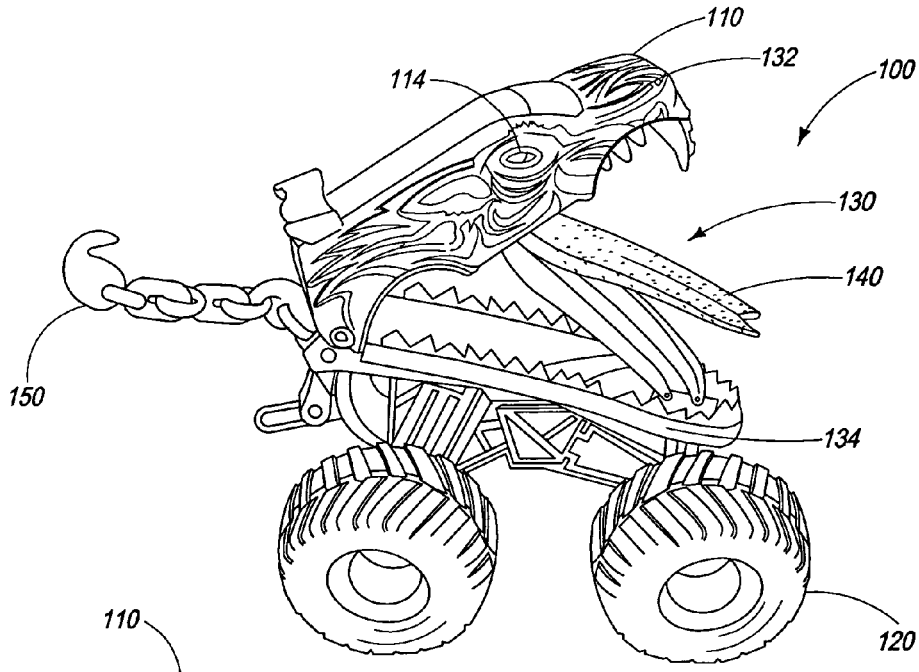
FIG. 1C is a side view of the toy vehicle of FIG. 1A in a third configuration.
Figure 1D:
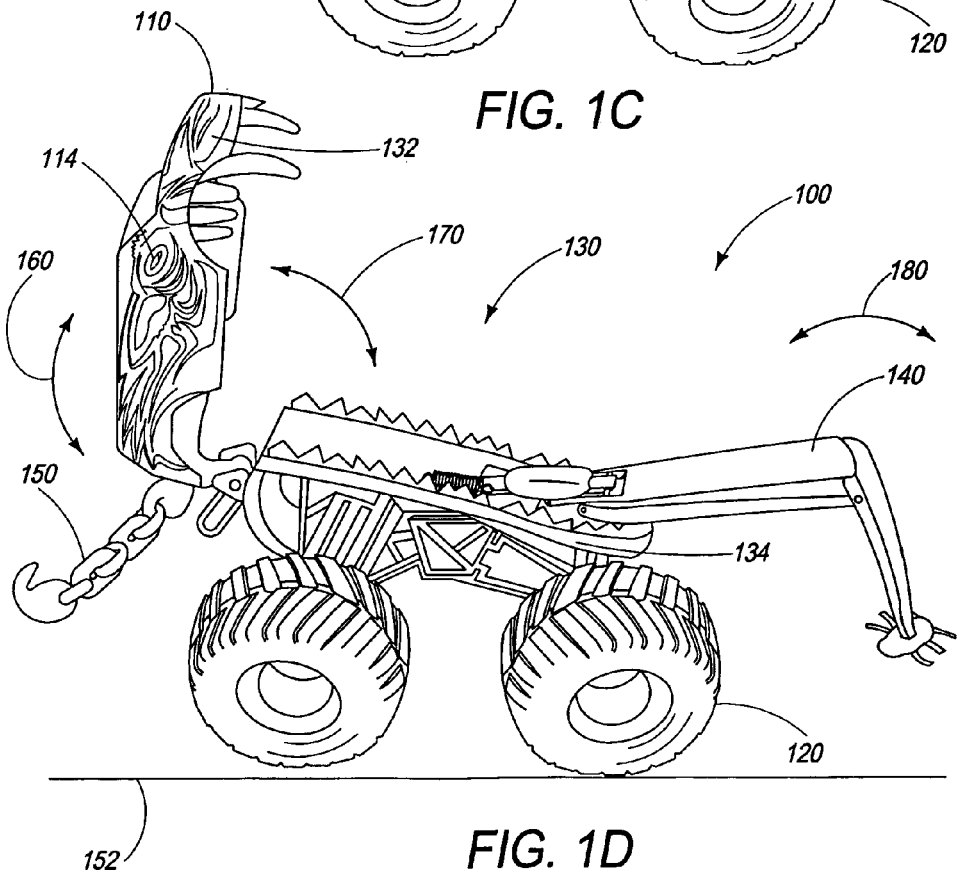
FIG. 1D is a side view of the toy vehicle of FIG. 1A in a fourth configuration.

In some embodiments, movement of the mouth between the various play configurations may generate tongue movement. For example, FIG. 1C provides a third play configuration, where the mouth 130 is in a second open (wide-mouth) position and the tongue 140 is raised from the lower jaw 134. In FIG. 1D, the toy 100 is shown in a fourth play configuration with an open mouth position. In some embodiments, the open mouth position may be the fully-open mouth position. In this open mouth position, tongue 140 may be configured to extend upwards and outwards from mouth 130 such that tongue 140 extends outward from the vehicle and downward towards a ground surface 152. In some embodiments, the tongue may approach or extend to the ground surface 152. For example, the tongue may be configured to touch or tap the ground surface. Additionally, the tongue may be adapted to touch or reach objects disposed or placed on the ground surface. Further, in some embodiments, the body and chassis may be angled down towards the ground surface to further enable the tongue to touch the ground surface in the extended or open mouth position.

In some embodiments, the tongue may be realistically curved such that the tongue more closely simulates a real tongue.

The various open mouth configurations may increase the excitement of the toy. As the mouth is opened wider, the toy may simulate an aggressor or represent a fighting sequence. For example, the toy may simulate an animal with chomping, biting, eating or other like capabilities. In some embodiments, the motion of the tongue may further add to the play value, such as, for example, enabling an attack mode, an eating mode, etc.

The various play configurations may be achieved through an interactive mechanism on the toy. For example, an actuator, such as an actuation lever 150 may be provided on the toy such that a user can actuate the actuator and position the toy in a select play configuration. Any suitable actuator may be used to select the play configurations. As an example, in the illustrated embodiment, the actuator may simulate a tail. Arrow 160 in FIG. 1D illustrates motion of the actuator in the form of a tail. Motion of the tail may result in motion of the mouth as indicated by arrow 170 and tongue motion or action 180.

In some embodiments, and as described in more detail in regards to FIGS. 4, and 5A-5C, tongue 140 may include one or more attachment portions adapted to enable the tongue to attach to different objects. In some embodiments, the tongue may be used to pick-up or grab objects positioned on the ground. For example, the tongue may include a sticky surface. In other embodiments, the tongue may include a magnetic portion, a mechanical claw, or other suitable structure to grab or pick up objects. It should be appreciated that the tongue may be a single tongue, a forked tongue, a multi-segmented tongue, a layered tongue, etc.

Figure 2A:
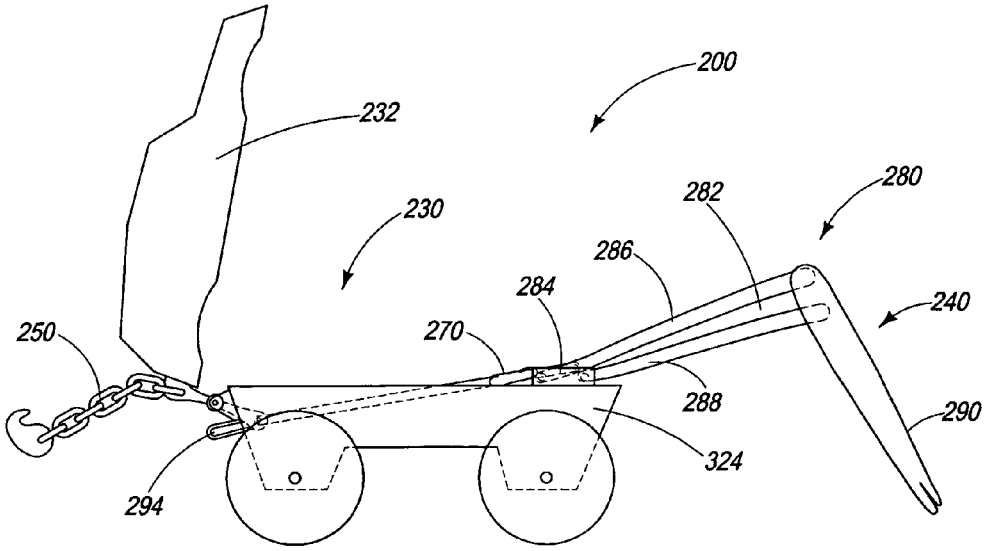
FIG. 2A is a simplified side view illustration of an example mechanism in an open position for an interactive feature for a toy vehicle.
Figure 2B:
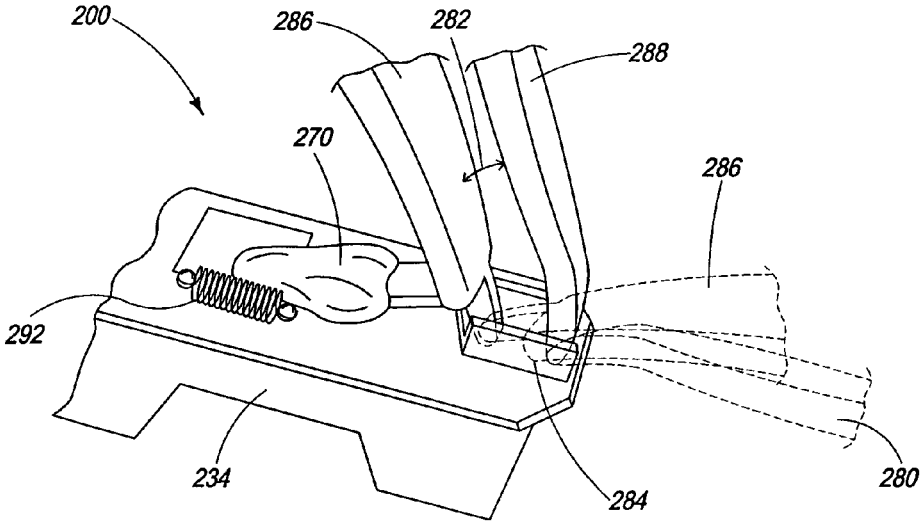
FIG. 2B is a simplified top view of the example mechanism of FIG. 2A.
Figure 2C:
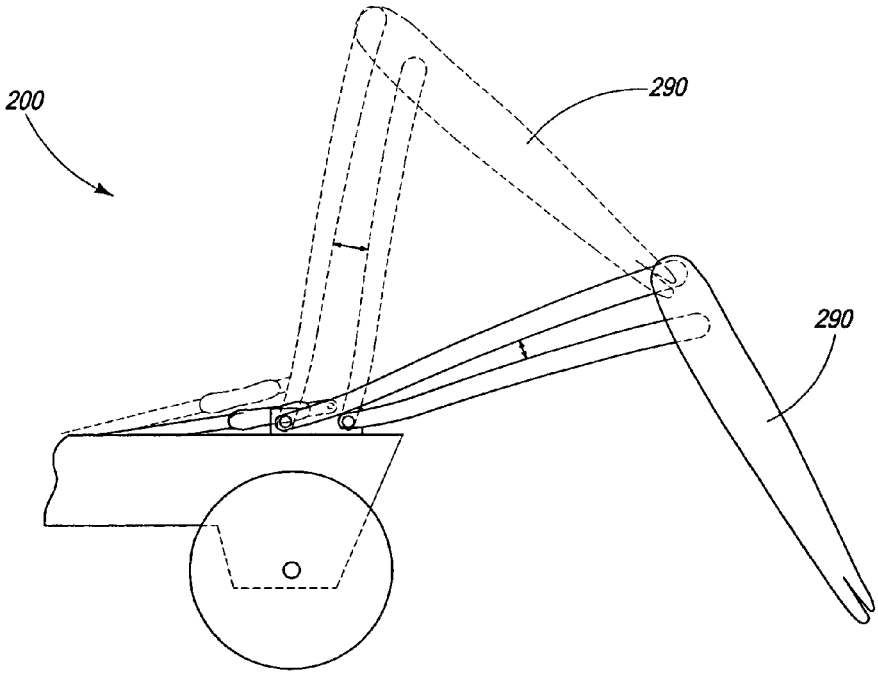
FIG. 2C is a simplified illustration of the example mechanism of FIG. 2A.

Referring now to FIGS. 2A-2C, toy 200 is illustrated where an interactive feature, such as tongue action may occur as the mouth is moved between the closed-mouth position and one or more of the open-mouth configurations. As described in regards to FIG. 1, in FIGS. 2A-2C, the vehicle may include any number of enhancements to provide the desired resemblance to a real or fantastical creature or object. Thus, although the motion is referred to in regards to mouth opening and tongue action, it should be appreciated that the mouth 230 may simulate other features of such real or fantastical creatures or objects. For example, the upper jaw 232 may simulate the hood or cap of a vehicle or engine compartment and the tongue 240 may simulate an engine explosion. Further, the upper jaw 232 may be a cap and the tongue 240 may simulate a flower, a snake, etc. which is escaping as the cap is opened. Thus, although described in regards to simulation of a mouth and tongue, the disclosure is not intended to be so limiting.

In the depicted embodiment, the mouth opening may be initiated by an actuator, e.g. mouth actuation lever 250, such as, for example, the tail or other extension from the body. The actuator may be user-manipulable. It should be appreciated that the tail may be a bumper, a spare wheel, a license plate, or other vehicle feature. Further the location of such actuation lever may vary without departing from the scope of the disclosure.

In the illustrated embodiment, as the mouth actuation lever 250 is rotated downwards and away from the body, the mouth may be coupled to the tail such that an upper jaw 232 of the mouth 230 is rotated open away from the lower jaw 234. Although the lower jaw 234 is shown fixed in the illustration, it should be understood that other contemplated mouth actuation levers may be used which rotate the upper jaw, rotate the lower jaw, or rotate a combination thereof. Additionally, the direction of rotation may vary depending on the coupling configuration.

Motion of the mouth beyond a predetermined limit may activate a tongue actuation mechanism. The tongue actuation mechanism may include a plurality of linkages which combined may be considered as the tongue. The multiple linkage configuration may enable the tongue to more closely simulate an animal's tongue as the tongue may extend both outwards from the vehicle and downwards towards a ground surface. Although a multiple linkage configuration is described, it should be appreciated that other linkage systems and tongue actuation mechanisms may be used without departing from the scope of the disclosure.

In the multiple linkage configuration, the tongue includes a plurality of linked segments or linkages. The linkages may be moveably coupled to each other such the tongue may be movable between a storage position and an extended position.

For example, in the illustrated embodiment, upon rotation of the upper jaw 232 away from the lower jaw 234 beyond a set rotation, the tongue-actuation mechanism may be activated. The tongue-actuation mechanism may include a four bar linkage 280. As such, four linkages may be arranged to form a substantial parallelogram shape 282. The four bar linkage may be activated through a coupling of tongue actuator 270 with the actuation lever 250. Each of the links of the four bar linkage 280 may be coupled to two other links by single joints or pivots to form a closed loop.

A first link or ground link 284 may be defined or disposed in the lower jaw. A second link (first extender) 286 and third link (second extender) 288 may be pivotally coupled to the first link 284. A fourth link (tongue extender) 290 may be pivotally coupled to the second 286 and third link 288. The first extender 286 may be adapted to move from a storage position where the first extender 286 may be substantially parallel to the lower jaw and ground surface. The third link (second extender) 288 may be substantially parallel to the second link (first extender) 286 and thus may be substantially parallel to the lower jaw and the ground surface when in the storage position.

The first and second extender, the tongue extender and the lower jaw may define a substantially trapezoidal space with the first and second extender operating as the substantially parallel sides of the trapezoidal space. In some embodiments, the trapezoidal space may appear substantially as a parallelogram and may be considered a parallelogram or four bar linkage system. It is noted that the linkages may define a substantial parallelogram, but that the parallelogram may not be a perfect parallelogram. For example, the first and second extender may be positioned such that the ends coupled to the first extender are slightly closer to each other and the ends coupled to the tongue extender are slightly further apart from each other (wider at the top) to aid the movement of the tongue extender towards the ground surface.

In some embodiments, the interior width of the trapezoidal (or parallelogram) space may vary as the tongue is moved between the storage position and the extended position. For example, in the storage position, the first and second extender may be substantially adjacent such that the space between the first and second extender is minimized. As the tongue is moved towards the extended position, the first and second extender may pivot from the lower jaw opening the width space between the first and second extender and defining a wider trapezoid. The first and second extender thus may move approximately 180 degrees as the tongue is moved between the folded position and the extended position. For example, the first and second extender may move from a position which is substantially parallel to the lower jaw, to a substantially perpendicular position relative the lower jaw to an extended position where again the first and second extender are substantially parallel to the lower jaw.

The first and second extender may be considered to have a substantially fixed end and a variable position end. The substantially fixed ends may be disposed in the forward portion of the lower jaw. The fixed ends may rotate about pivot points in the forward portion of the lower jaw. The tongue extender may be rotatably coupled to the variable position ends of the first and second extender. Thus, as the first and second extender travel from the storage position to the extension or capture position, the tongue extender may similarly rotate about the first and second extenders. In the depicted embodiment, the tongue extender may be disposed substantially adjacent and parallel one of the first and second extenders in the folded position and then swing outwards away from the first and second extenders such that the tongue extender is perpendicular to the first and second extenders in the extended position.

Referring to the full system, an actuator, such as the tail, may be coupled with the four bar linkage system. For example, rotation of the tail in a downwards direction, may trigger motion of the first linkage such that the first linkage rotates the first and second extender from the folded position. As the first and second extender rotate outward, the tongue extender may pivot outwards and downwards to the ground surface.

In some embodiments, a biasing mechanism, such as a spring may further enhance the interactive feature. For example, a biasing mechanism may make the tongue action more life-like. In some embodiments, a spring may be configured to pull the parallelogram back as the upper jaw is lowered. The spring may prevent the upper jaw from closing on the tongue. The spring may be selected based on a variety of factors. For example, the spring may be selected such that a user may operate the actuator single-handedly. Further, the strength of the spring may be selected such that a user may push the tongue to a full extension without the front wheels of the vehicle raising from the ground surface.

As another example, the tongue may be biased in the storage position. Movement of the actuator may operate against the spring such that the tongue returns or rebounds to the storage position upon release of the actuator.

For illustration purposes, a coil spring is shown in FIG. 2B linked to the tongue actuation mechanism. As one example, upon activation of the actuator, the spring may be loaded as the tongue is moved to the extended position. Upon release of the actuator, the spring rebounds, pulling the tongue from the extended position back to the storage position.

As discussed above, the tongue actuation mechanism may be triggered by an actuator. In some embodiments, the actuator, such as the tail, may be preset such that there is a delayed action of the tongue-For example, the tail may be operably linked to the four bar linkage though a delay slot. Initial movement of the actuator may result in any transferable motion being accommodated within the delay slot. Thus, the tongue actuation mechanism is not triggered until the actuator engages a stop within the delay slot causing activation of the tongue-action mechanism. This delayed linkage system may prevent the tongue from extending outward until the mouth has opened a set amount. Delay in the tongue action mechanism may enable the mouth to be sufficiently wide enough to allow the tongue to extend without interference from the mouth. Additionally, another play configuration may be possible, where a user can open the mouth without activating the tongue motion. Such a play configuration may enhance the confrontational play between toys.

Figure 3:
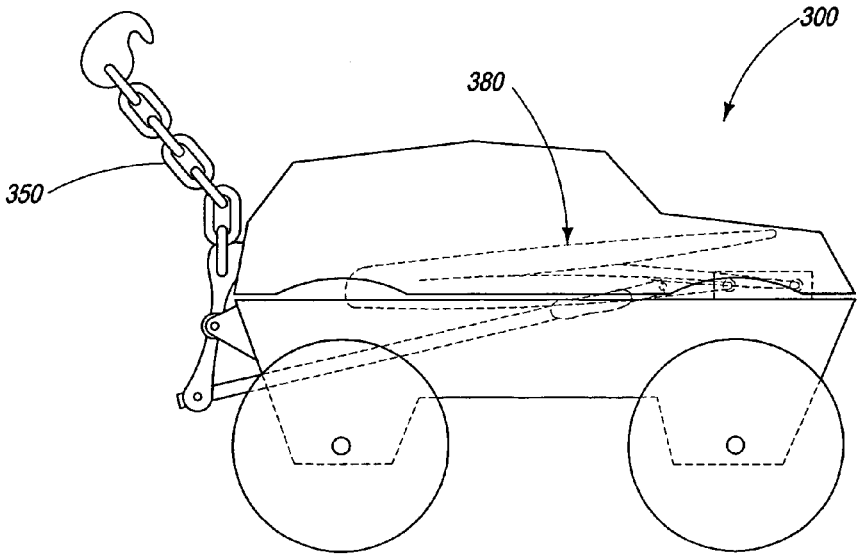
FIG. 3 is a simplified illustration of the example mechanism in a closed position for an interactive feature for a toy vehicle.
Figure 4:
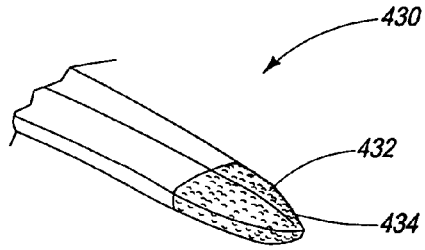
FIG. 4 is an example interactive feature for a toy vehicle.

FIG. 3 provides an illustration of a toy vehicle 300 in a closed mouth configuration. An interactive feature, such as tongue actuation, mechanism 380 may be disposed in a storage position such that the tongue is hidden from view. The storage position may be considered a folded position with the trapezoidal linkage system described above. For example, with the trapezoidal linkage system, the first and second extender may fold over the first linkage such that the variable position ends of the first and second extender are disposed towards the rear of the vehicle. The tongue extender may then fold over the first and second extender such that the tip of the tongue extender is disposed towards the front portion of the vehicle. This configuration may further enhance the realistic effect of the tongue as the tongue appears towards the front of the mouth. Activation of tongue actuation mechanism, such as through actuation lever 350, may result in the mouth opening to one or more of the play configurations described previously.

Although any suitable tongue actuation mechanism may be provided in the illustrated embodiment, a segmented linkage system is illustrated. The segment linkage system includes a plurality of links which may be folded over each other forming a storage position.

As described above in regards to FIG. 1D, in some embodiments, the tongue actuation mechanism may enable the tongue to extend outward from the vehicle and downward toward a ground surface 152. The tongue may thus be adapted to extend towards objects positioned on the ground surface. For example, activation of the tongue action mechanism may result in the tongue engaging a rock or other toy positioned on the ground surface. In some embodiment, the tongue may be configured to capture the object such that the tongue substantially contacts, engages, or locks onto the object. As such the tongue may be moveable between a storage position and a capture position. In some embodiments, capture may thus include detachably engaging an object with the tongue. In some embodiments, the object may be of the appropriate size and/or weight, such that capture of the object with the tongue may include a locking engagement which enables the object to be lifted or raised from the ground surface.

Referring to FIGS. 4 and 5A-5C, the tongue may include engagement structure for capture of the objects. The engagement structure may be adapted to engage the object. Example engagement structures include sticky materials, magnets, mechanical claws, etc. As a first example, and not as a limitation, in FIG. 4, the tongue may include engagement structure such as sticky material. For example, a contact portion of the tongue 432 may include engagement structure, such as one or more sticky surfaces 434. For example, the top, bottom and sides of the tip of the tongue may be covered with a sticky material. In some embodiments, the contact portion may be confined to a tip or edge region of the tongue. However, in other embodiments, the entire tongue, or a larger portion of the tongue may be considered the contact portion and may include one or more sticky surfaces.

The sticky material may be applied as a coating, a dip, a decal or a sticker to the tongue surface, such as the tip of the tongue extender. In other embodiments, the contact portion of the tongue may be made or partially made of a sticky material. The sticky material may include a sticky elastomeric material, a slow-setting adhesive, a charged material, such as an electrostatically charged material, a mechanically-sticky material, such as hook and loop fasteners which may stick to selective mating materials, mechanical cups or other structures which when compressed against an object at least temporarily lock the tongue against the object.

FIGS. 5A-5D illustrate other engagement structures for tongue 530. For example, in FIGS. 5A-5C, the tongues include claw structures. The claw structures may be mechanically actuated such that a user may operate the claw. Further, in some embodiments, the claw may be biased such that contact of the claw against an object results in the operation of the claw. For example, the claw may be spring-biased such that upon contact with an object or the ground surface the claw moves between an open and a closed position. In other embodiments, the tongue may be electronically controlled, such that a user may selectively open and close the claw portion of the tongue.

Figure 5A:
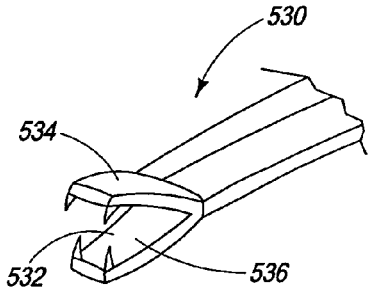
FIGS. 5A-5D are additional examples of interactive features for a toy vehicle.
Figure 5B:
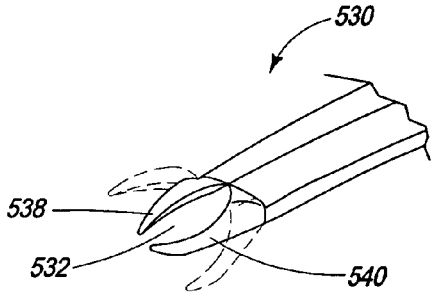
Figure 5C:
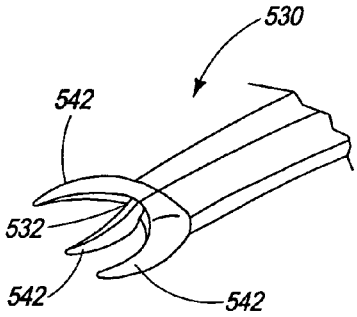

The claw portions of the tongue may be adapted such that the tongue simulates forked tongues, multi-segmented tongues, layered tongues, etc. In FIG. 5A, the contact portion 532 of tongue 530 may be layered, including an upper layer 534 and a lower layer 536. The upper and lower layer may define a mechanical claw or clamp. An object may be captured as the upper and lower layers are drawn together to capture an object. In some embodiments, fangs or teeth may be provided to secure an object which is captured within the upper and lower layers. Similarly, in FIG. 5B, a forked tongue is illustrated having a contact region 532 including a first segment 538 and a second segment 540 which may be opened and closed to capture an object. FIG. 5C illustrates a multi-segmented tongue 530 having a contact portion 532 comprising a plurality of segments 542. The segments may function to grab an object or portion of an object.

Figure 5D:
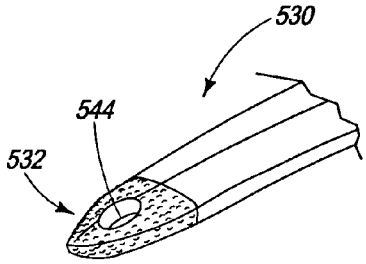

FIG. 5D provides another alternative for the tongue. For example, in some configurations, tongue 530 may include a contact portion 532 with one or more receiving slots 544. Receiving slots 544 may be adapted to couple the tongue to various objects. For example, the slot may be adapted to engage a tail of a toy rat such that the toy rat may be picked up by the tongue. In other embodiments, mating features may be applied to the tongue (e.g. protuberances, detents, snaps, etc) and corresponding objects. The mating features may enable capture and lifting of the objects.

It should be appreciated that the tongue may be made of different materials without departing from the scope of the disclosure. Thus, in some embodiments, the tongue may include a rubber tongue extender and plastic or other substantially rigid extensions or linkages. In other embodiments, the tongue linkages and tongue extender may be made of similar materials. Coatings and paint may be used to further simulate the appearance of the tongue.

Figure 6:
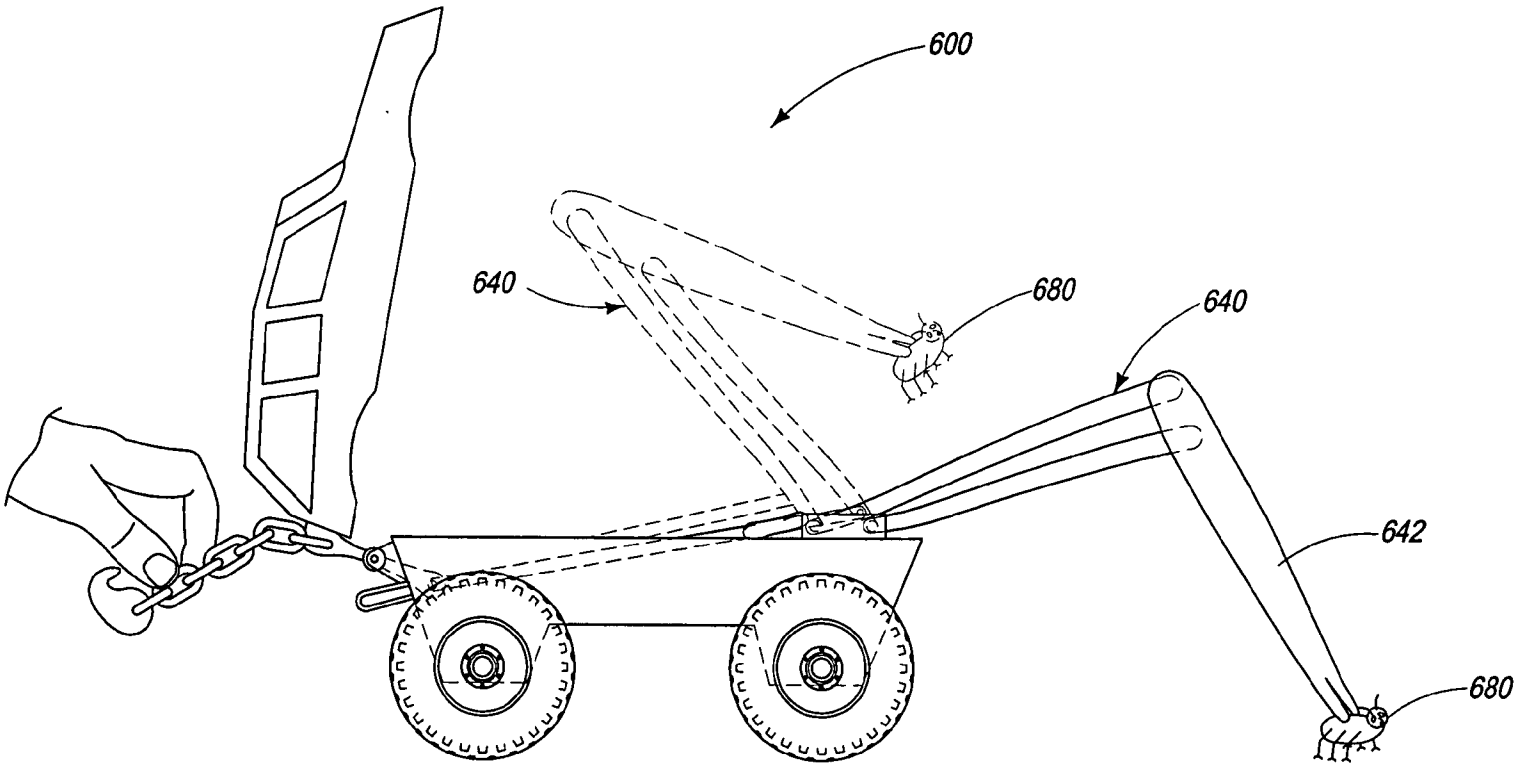
FIG. 6 illustrates operation and play with an interactive toy vehicle.

FIG. 6 further illustrates operation and play with an interactive toy vehicle. As described above, in some embodiments a toy vehicle 600 may be provided with one or more interactive features, such as a tongue actuation mechanism 640. The tongue actuation mechanism may be selectively activated by a user. For example, as illustrated, a user may engage and activate an actuation lever, such as the tail. The upper jaw of the vehicle may be movably coupled to the actuator such that the upper jaw cause rotation of the upper jaw from the lower jaw resulting in the opening of the mouth. Such movement may result in enhanced simulation of a fantasy or real animal or beast. With opening of the mouth, the tongue actuation mechanism may be triggered such that the tongue extends upward and outward from the vehicle. A user may selectively activate the tongue actuation mechanism such that the tongue captures an object 680. Although shown as a relatively-small sized object, the tongue may capture larger objects by temporarily locking or engaging against the object. For example, the tongue may be activated such that it engages a second vehicle of similar size. In such embodiments, the tongue may be used as a weapon and may target spots on the other vehicle for points or other game play.

In some embodiments, the tongue may sufficiently engage the object such that the object may be lifted from the ground surface. The tongue may further be configured to lift the object upwards into the body of the vehicle. In the illustrated embodiment, a toy bug 680 is shown captured by tongue 642. The toy bug is detachably coupled to the contact portion of the tongue such that the toy bug is temporarily locked to the tongue. The tongue may be moved into the folded or storage position, thus moving the toy bug into the mouth of the vehicle, as illustrated in dashed lines. The vehicle may be considered to "eat" the object. In some embodiments, a receiver may be provided in the mouth for collection of the objects. Although in some embodiments, the upper jaw may fully close around the captured object, the invention is not so limited. Thus, in some embodiments, the upper jaw may close until it engages the collected object. In such a configuration, the mouth may not fully close after collection of an object. Further a release mechanism may be provided to enable release of the objects "eaten" by the toy.

In some embodiments, the tongue may engage an object such that the object is captured, although not eaten. The captured object may be detachably coupled to the tongue. In some embodiments, the captured object may be lifted toward the mouth by activation of the mouth-action mechanism. However, the size of the object may prevent release of the object in the mouth. Play value may be increased as a child activates that tongue action mechanism, releasing the tongue and capturing a select object, such as another vehicle or obstacle. A child may compete with another vehicle in capture skills and lift skills.

It should be appreciated that the above description is illustrated and described in regards to inclusion of a tongue actuation mechanism on a toy vehicle. However the tongue actuation mechanism may be incorporated in any other suitable toy such that the toy's play value is increased. For example, a non-wheeled toy may include a tongue actuation mechanism which is adapted to move the tongue from a storage position to an extended position. The tongue may move upwards from the toy and outwards towards a ground surface. Further, the structure of the tongue actuation mechanism and/or the tongue contact region and engagement structures may be incorporated in a non-wheeled vehicle. Such interactive features may enhance the simulation of the toy, provided additional gaming and skill challenge and increase the overall toy experience for the child.

Figure 7:
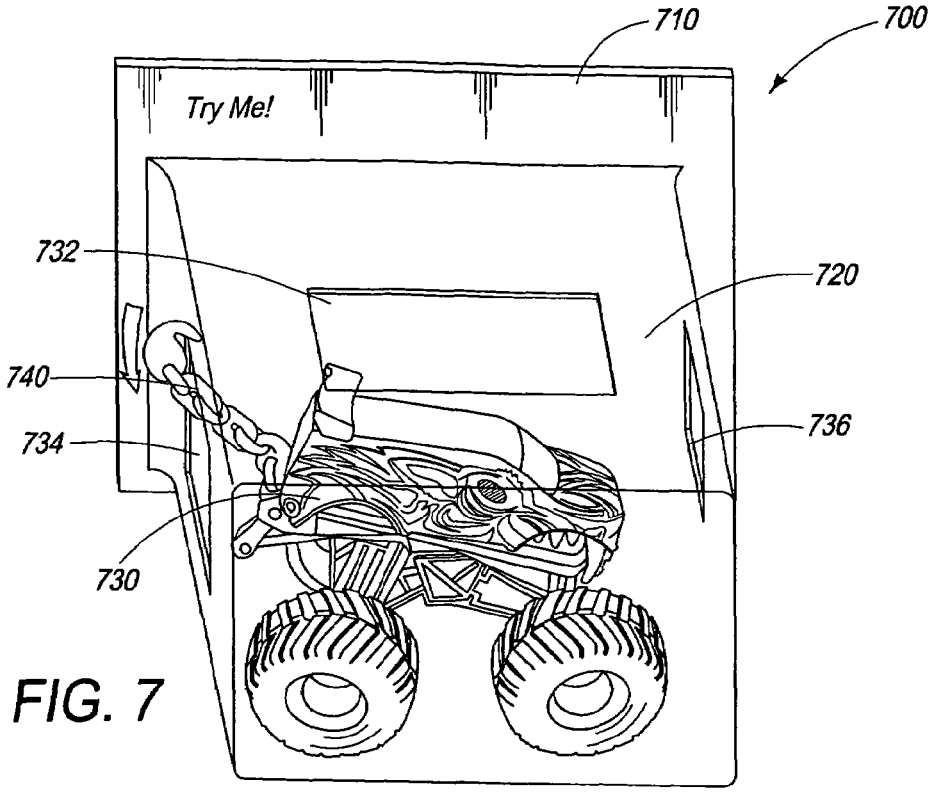
FIGS. 7 and 8 are exemplary packaging for an interactive toy.
Figure 8:
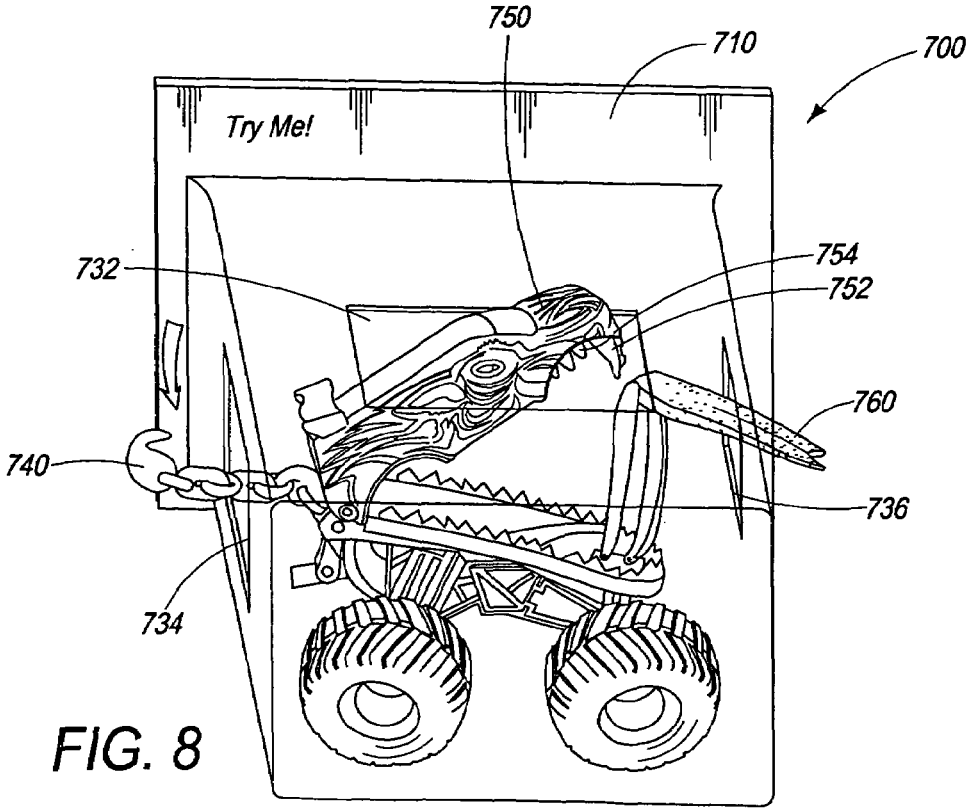

The above described toy may be presented to a consumer such that the consumer is able to experience the interactive features of the toy. For example, a specialty package may enable a "try me" experience for the consumer. FIGS. 7 and 8 illustrate an exemplary packaging providing access to the interactive features of the toy. Specifically, as shown in FIGS. 7 and 8, the packaging may include a retainment card and a toy enclosure. The vehicle may be positioned within the toy enclosure (such as a plastic or transparent cage) in a first play configuration where the mouth is in a closed position. In this first play configuration, the toy may more closely resemble an authentic vehicle, such as a super-sized truck or monster truck.

Apertures in the packaging may enable the user to activate the actuator lever such that the mouth opening and tongue actuation mechanisms are triggered. As an example, the tail may extend through a rear side aperture in the packaging. A user may pivot the tail downwards triggering the mouth opening and tongue actuation mechanism.

Each of these movements may then be accommodated by the packaging. For example, as the mouth is opened to a different play configuration, such as the open mouth configuration, the upper jaw may extend through a top surface aperture in the packaging. Fangs and teeth may become exposed and may be touchable by a consumer. The inside region of the mouth of the toy vehicle may thus be revealed to a potential consumer. Design elements may be provided to further simulate a mouth providing a consumer with enhanced simulation of a beast or animal.

As another example, the tongue may project through and front side opening. Release of the actuation lever by the potential consumer may result in return of the vehicle to the first play configuration (closed mouth configuration). In some embodiments, the aperatures may be sized to prevent abuse to the toy during the "try me" experience. Thus, in some embodiments, the packaging may have few if any apertures. Further some packages may have a stop, such that the tongue and/or the upper jaw cannot extend beyond a desired extension level out of the package. For example, some packages may not have an aperture for opening of the upper jaw. Thus, although a user may be able to actuate the lever, the play configuration may be limited preventing full extension of the tongue. In other embodiments, the upper jaw may have sufficient clearing in the packaging whereby no aperture is needed to enable full extension of the tongue.

It will be appreciated that the configurations and embodiments disclosed herein are exemplary in nature, and that these specific embodiments are not to be considered in a limiting sense, because numerous variations are possible. The components, shapes, colors, etc. described herein are non-limiting examples and it should be understood that each of these features may be changed.

The subject matter of the present disclosure includes all novel and nonobvious combinations and subcombinations of the various systems and configurations, and other features, functions, and/or properties disclosed herein. The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A toy vehicle having an interactive feature, the toy vehicle comprising:

a body including an upper jaw and a lower jaw;

at least two wheels rotatably coupled to the lower jaw of the body; and a tongue actuation mechanism moveably coupled to the lower jaw of the body, the tongue actuation mechanism including a tongue extender having an engagement portion, the tongue actuation mechanism adapted to enable selective movement of the tongue extender from a storage position folded substantially flat within the body to a capture position unfolded at least partially exterior the body, where in the capture position the tongue extender extends downwards approaching a ground surface for capture of an object to the engagement portion of the tongue extender, the tongue actuation member further adapted to pivot the upper jaw away from the lower jaw as the tongue extender moves from the storage position to the capture position and to pivot the upper jaw toward the lower jaw as the tongue extender moves from the capture position to the storage position.

2. The toy vehicle of claim 1, wherein the tongue actuation mechanism includes a linkage with at least four links.

3. The toy vehicle of claim 2, wherein the links include a first extender and a second extender where the first extender and second extender are substantially parallel and define the sides of a shape similar to a parallelogram.

4. The toy vehicle of claim 3, wherein the tongue extender folds over the first and second extender in the storage position such that the tongue extender is substantially parallel to the first and second extender in the storage position.

5. The toy vehicle of claim 3, wherein the tongue extender is adapted to rotate about the first and second extender such that the tongue extender is substantially perpendicular to the first and second extender in the capture position.

6. The toy vehicle of claim 1, wherein the tongue actuation mechanism is triggered through a user-manipulable actuator.

7. The toy vehicle of claim 6, wherein the actuator simulates a tail.

8. The toy vehicle of claim 6, wherein the tongue extender is configured to touch the ground surface.

9. The toy vehicle of claim 6, wherein the user-manipulable actuator is fixedly coupled to the upper jaw of the body.

10. The toy vehicle of claim 1, wherein the tongue extender is adapted to pick up an object.

11. The toy vehicle of claim 1, wherein the engagement portion is a sticky material.

12. The toy vehicle of claim 11, wherein the sticky material is a soft elastomeric material.

13. The toy vehicle of claim 1, further comprising a package including an actuator aperture for access to an actuator for triggering the tongue actuation mechanism and a tongue extender aperture for receipt of the tongue extender when in the capture configuration.

14. The toy vehicle of claim 1, wherein the tongue actuation mechanism further includes a spring.

15. A toy with an interactive feature comprising:

a body including a user-manipulable actuator; the body further comprising:

a mouth including an upper jaw and a lower jaw, the mouth being moveable upon activation of the actuator, the mouth moveable between at least one open configuration and a closed configuration; and a tongue moveable, upon movement of the mouth to the open configuration, from a storage position, where the upper jaw and the lower jaw are closed together and the tongue is substantially disposed between the upper jaw and the lower jaw, to an extended position, where the upper jaw and the lower jaw are spread apart and the tongue is disposed upward and outward from the lower jaw, wherein the tongue includes a linkage with at least four members.

16. The toy of claim 15, wherein the linkage includes a plurality of links, including a first extender and second extender pivotal about the lower jaw, wherein the first extender and second extender are substantially parallel.

17. The toy of claim 16, wherein the links further include a tongue extender rotatably coupled to the first extender and the second extender.

18. The toy of claim 16, where in the storage position, the first extender and second extender are substantially parallel to a ground surface.

19. The toy of claim 15, where the mouth is moveable to a partially open position where the tongue remains in a storage position.

20. The toy of claim 19, wherein the tongue is moveable when the mouth is moved beyond the partially open position.

21. The toy of claim 15, further comprising wheels coupled to the body.

22. The toy of claim 15, wherein the tongue is adapted to touch a ground surface.

23. The toy of claim 15, wherein the tongue includes engagement structure for coupling an object to the tongue.

24. The toy of claim 23, wherein the engagement structure includes sticky material.

25. A toy vehicle comprising:

a body including a mouth having at least one moveable portion and a tongue, wherein the tongue is moveable between a storage position providing a first play configuration and a capture position providing a second play configuration, where the tongue in the capture position is adapted to extend downwards towards a ground surface to capture an objects, a tail fixedly coupled to the moveable portion of the mouth and moveably coupled to the tongue, such that pivoting the tail lifts the moveable portion of the mouth open and moves the tongue from the storage position to the capture position, and a plurality of wheels rotatably coupled to the body.

26. The toy vehicle of claim 25, wherein a third play configuration is provided where the tongue remains in a storage position and the mouth is in a partially open position.

27. The toy vehicle of claim 25, wherein the tongue includes engagement structure to couple the object to the tongue.

28. The toy vehicle of claim 27, wherein the engagement structure includes sticky material.

29. The toy vehicle of claim 25, including a linkage with at least four members for movement of the tongue between the storage position and the capture position.

* * * * *